United States Patent [19]

Schaaf

[11] Patent Number: 4,932,812

[45] Date of Patent: Jun. 12, 1990

[54] INTERMESHABLE CONSTRUCTION UNIT

[76] Inventor: Cecil F. Schaaf, 3015 Palmer Rd., Standish, Mich. 49658

[21] Appl. No.: 390,476

[22] Filed: Aug. 3, 1989

Related U.S. Application Data

[63] Continuation of Ser. No. 30,956, Mar. 26, 1987, abandoned.

[51] Int. Cl.[5] ..... E02D 17/20; E02D 29/02

[52] U.S. Cl. ..... 405/284; 52/604; 405/286; 446/125

[58] Field of Search ..... 405/33, 273, 284, 285, 405/286, 287; 52/590, 604, 605; 404/44; 446/125

[56] References Cited

U.S. PATENT DOCUMENTS

| | | | |
|---|---|---|---|
| 543,582 | 7/1895 | Meyenberg | 52/590 X |
| 735,079 | 8/1903 | Fisher | 52/590 |
| 3,269,125 | 8/1966 | Moore | 405/286 X |
| 3,379,015 | 4/1968 | Macks | 405/33 |
| 3,631,682 | 1/1972 | Hilfiker et al. | 405/273 |
| 4,490,075 | 12/1984 | Risi et al. | 405/273 |
| 4,613,255 | 9/1986 | Bruer | 405/286 |

FOREIGN PATENT DOCUMENTS

| | | | |
|---|---|---|---|
| 45953 | 3/1980 | Japan | 405/33 |
| 519723 | 4/1940 | United Kingdom | 446/125 |
| 82/02341 | 7/1982 | World Int. Prop. O. | 446/125 |

*Primary Examiner*—David H. Corbin
*Attorney, Agent, or Firm*—Dykema Gossett

[57] ABSTRACT

An intermeshable construction unit for constructing structures, such as walls, paving, screens, embankments and the like without mortar is disclosed. The intermeshable construction unit has a body portion which is block-like in shape. The body portion has a top, a bottom, a front end, a back end, and two opposed sides. A central spine having two sides runs along the central axis of the body portion between the front end and the back end. A plurality of teeth protrude from both sides of the central spine to form a web with each of the teeth terminating along the opposed sides. The teeth are separated by notches which have a width greater than the width of each of the teeth so that the units may be aligned, whereby one intermeshable construction unit may be meshed with another intermeshable construction unit to interlock the units. The intermediate construction units may be adapted within three planes during construction, namely the vertical, horizontal and diagonal planes. Thus, by staggering or off-setting the teeth from notch-to-notch, several patterns for structures can be designed for easy construction on sight by general labor. To increase the load bearing capacity of the intermeshable construction units, the units may be laid on a designed aggregate base in combination with geotextile fabrics.

5 Claims, 2 Drawing Sheets

INTERMESHABLE CONSTRUCTION UNIT

This is a continuation of co-pending application Ser. No. 07/030,956 filed on Mar. 26, 1987, now abandoned.

FIELD OF THE INVENTION

The present invention relates to an intermeshable construction unit, one aspect of which is that the teeth of one unit may mesh with the teeth of another unit to construct structures, such as walls, paving, screens, fences, embankments and the like without the use of mortar.

BACKGROUND OF THE INVENTION

Conventional bricks or blocks have long been used to construct, for example, walls as disclosed in U.S. Pat. No. 3,894,397 (Fair), the disclosure of which is hereby incorporated by reference. However, several limitations and disadvantages have been associated with the use of such construction units, principally of which has been the need for the use of mortar between the blocks or mechanical fasteners to provide stability. In addition, they could not readily be utilized to form diagonal structures. However, the disadvantages and limitations associated with such construction units are more readily recognized in regard to sound barrier walls or privacy fences, which heretofore could not easily be constructed with voids, indentations and extrusions produced within the wall face that could absorb or reflect noise. An example of such would be highway sound barriers and retainer embankments which are either of wood, concrete blocks or precast segments of concrete lowered in place and retained along their ends by supports. Such concrete blocks have included generally T-shaped blocks as disclosed, for example, in U.S. Pat. No. 3,282,052 (Saginor), the disclosure of which is hereby incorporated by reference. In addition to the previously mentioned limitations, the precast segments require staggering of sections as the only means by which to provide some aesthetic features to the walls.

Also, structures constructed in accordance with the above do not provide sufficient permeability for use in present day landscaping, and do not provide sufficient expansion and contraction. However, blocks have been suggested for breakwaters as disclosed, for example, in U.S. Pat. No. 2,474,786 (Humphrey) and for granaries as disclosed, for example, in U.S. Pat. No. 1,277,829 (Baum), the disclosures of which are both hereby incorporated by reference.

Thus, there has been a need for an intermeshable construction unit which would not require mortar for interlocking, yet provide durability, economy, appearance, utility and good acoustics. In addition, such an intermeshable construction unit should be capable of being used to create symmetrical or random designs featuring voids, indentations and extrusions within a wall space that can baffle, absorb or reflect noise. Also, the intermeshable construction units should be able to mesh with one another to allow the structure to flex during periods of expansion and contraction. Further, structural strength should be able to be increased by zig-zagging or curving the vertical wall plane of a structure. Lastly, when intermeshable construction units are constructed in a diagonal plane, they should be able to armor, retain or change the angle of repose of a natural embankment.

SUMMARY OF THE INVENTION

In contrast to the prior art construction units and structures acknowledged above, the intermeshable construction unit of the present invention utilizes protruding teeth to mesh with one another without mortar to form structures. The invention herein contemplates an intermeshable construction unit which includes a body portion, which in the preferred embodiment is block-like in configuration. The body portion has a top, a bottom, a front end, a back end and two opposed sides. A central spine having two sides runs along a central axis of the body portion between the front end and the back end. A plurality of teeth protrude from both sides of the central spine. The teeth terminate at the opposed sides of the body portion. In the preferred embodiment, the teeth are separated by notches.

Also, in the preferred embodiment, each of the teeth has two opposed sides which are parallel to one another and perpendicular to the central axis of the body portion. In addition, the width of each notch is greater than the width of each of the teeth. Thus, when one unit is brought into contact with another unit, for example to construct a wall, the teeth of one unit may mesh with the teeth of the other to interlock the units. Sufficient clearance may be provided between the intermeshing teeth of one unit and the other so that materials such as sand may be placed therein.

Further, in the preferred embodiment, the teeth protrude from the spine opposite one another, and the notches run the full height of the body portion from the top to the bottom along each side. Lastly, the front end and the back end of the body portion each has a substantially flush face, which includes adjacent opposite teeth.

The invention herein also contemplates a structure of a plurality of intermeshable construction units. At least a portion of the intermeshable construction units include a body portion having a top, a bottom, a front end, a back end and two opposed sides. A central spine has two sides and runs along a central axis of the body portion between the front end and the back end of the body portion. A plurality of teeth protrude from both sides of the central spine. The teeth terminate at the opposed sides of the body portion. The intermeshable construction units are stacked, so that at least a portion of the teeth of one unit may mesh with at least a portion of the teeth of another unit to interlock the units.

In the preferred embodiment, the teeth of the units are separated by notches. The width of each notch is greater than the width of each of the teeth. Further, in the disclosed embodiment, the teeth of at least one of the units are positioned upright relative to the other units, or the teeth of at least one of the units are positioned to the side relative to the other units.

DESCRIPTION OF THE DRAWINGS

The various features, objects, benefits, and advantages of the present invention will become more apparent by reading the following detailed description of the preferred embodiment in conjunction with the drawings wherein like reference numerals identify corresponding components, and.

DETAILED DESCRIPTION OF THE PREFERRED EMBODIMENT

Figure 1:
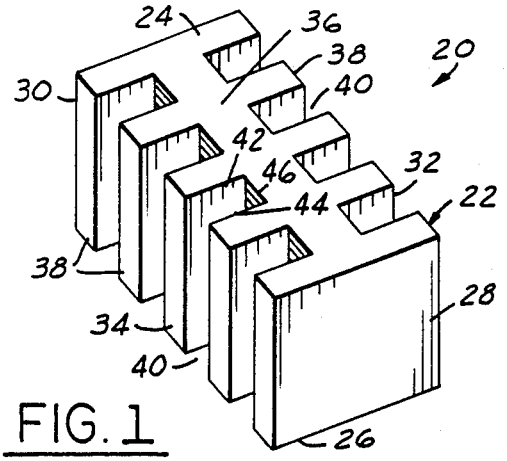
FIG. 1 is a perspective view of an intermeshable construction unit of the present invention.

Referring to FIG. 1, the intermeshable construction unit of the present invention, generally designated 20, is illustrated. The intermeshable construction unit 20 includes a body portion 22 of block-like configuration. The body portion 22 has a top 24, a bottom 26, a front end 28, a back end 30 and two opposed sides, a right side 32 and a left side 34. A central spine 36 having two sides runs along the central axis of the body portion 22 between the front end 28 and back end 30. In addition, a plurality of teeth 38 protrude from both sides of the central spine 36. The teeth 38 terminate at the opposed sides 32 and 34, and at the top 24 and the bottom 26. The orientation of the various sides is not essential to the present invention but is utilized for purposes of discussion to provide reference to one another.

The teeth 38 are separated by notches 40, and each of the teeth 38 has two opposed sides 42 and 44 running parallel to one another and perpendicular to the central axis of the body portion 22. The sides of opposite teeth lie in the same plane. Each side is connected to the side of the adjacent tooth 38 by a trough 46. In the preferred embodiment, the teeth 38 on the right side 32 are opposite the teeth 38 on the left side 34. However, it should be appreciated that the teeth may be staggered (not shown).

Figure 2:
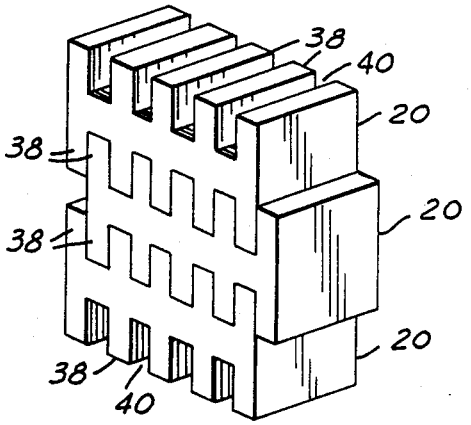
FIG. 2 is a perspective view of three intermeshable construction units of the present invention stacked vertically.
Figure 3:
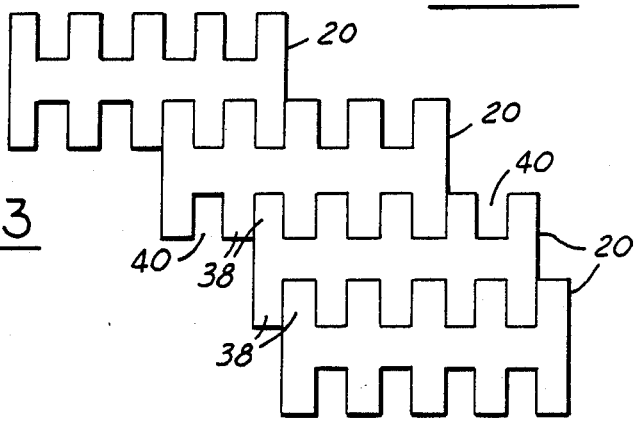
FIG. 3 is a plan view of four intermeshable construction units of the present invention stacked horizontally.
Figure 4:
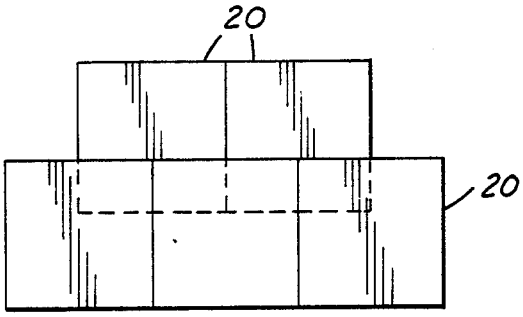
FIG. 4 is an end view of the intermeshable construction units of the present invention stacked with the teeth upright.
Figure 5:
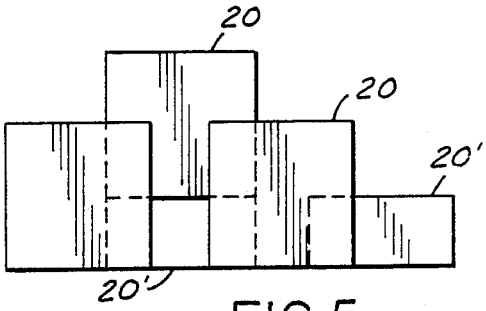
FIG. 5 is an end view of the intermeshable construction units of the present invention stacked with the teeth positioned to the side.

The width of each notch 40 is greater than the width of each of the teeth 38 so that the units may be aligned to intermesh with one another as illustrated in FIGS. 2 and 3. To control sheer plane within intermeshable construction unit structures, it is recommended that a common brick-style bonding pattern be utilized where the teeth are placed upright as illustrated in FIG. 4. When the teeth are positioned to the side, a pattern using split or half units 20′ may be constructed by alternating the split with every other full unit 20 as illustrated in FIG. 5.

The illustrated embodiment includes five teeth 38 protruding from the right side 32 and the left side 34 to form a flush face along the front end 28 and along the back end 30 of the body portion 22. However, the particular number of teeth 38 is not essential to the present invention.

The particular material used for the intermeshable construction units 20 of the present invention may vary, but it is intended that in most applications, the material be generally rigid. Thus, concrete, wood, polymers and the like may be utilized depending upon the intended use. When utilized in construction, concrete of a mixture of heavy weight aggregate or limestone with chips conforming to the ASTM standards, ASTM C-33 and ASTM C-90 Grade N is preferred. Also, to achieve a tight water-repellent concrete intermeshable construction unit 20, Dry Block by Forrer Chemical may be utilized to control water absorption and efforvescence. In addition, for aesthetic purposes, colors may be added to the aggregate mixture for either dry or liquid systems. Normally, the manufacture of this product will select the best commercially available materials based upon price, application and manufacturing process.

There are several ways to mass produce the intermeshable construction units 20 of the present invention which are well known to those skilled in the art, such as for example, on a standard block machine utilizing a very dry concrete mixture at high pressure.

OPERATION AND USE

The operation and use of the intermeshable construction units 20 of the present invention having for example, five teeth 38 and made of concrete, will now be explained. The intermeshable construction units may be adapted within three planes during construction, namely the vertical, horizontal and diagonal planes. Unlike conventional wall structures, the intermeshable construction units are stacked without mortar by intermeshing the teeth. This allows the entire wall to flex during periods of expansion and contraction. Also, by staggering or offsetting the teeth 38 from notch-to-notch 40, several patterns can be designed for easy construction on sight by general labor, as illustrated in FIGS. 6, 7 and 8.

Figure 6:
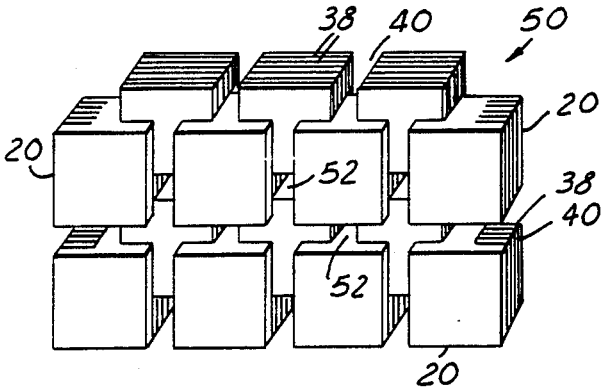
FIG. 6 is a perspective view of the intermeshable construction units stacked to create a vertical wall structure with openings therein.

As illustrated in FIG. 6, the intermeshable construction units 20 may be stacked vertically to form a wall or fence structure 50 having holes 52 formed therein to satisfy all of the basic requirements, including durability, economy, appearance, utility and good acoustics. It is the latter design quality that makes the unit stand out for the construction industry. Thus, as a sound barrier or privacy fence, the intermeshable construction units can create symmetrical or random designs. Voids, indentations and extrusions may be produced within the wall space that will baffle, absorb or reflect noise. Also, it should be appreciated that the intermeshable construction units may be stacked with the teeth positioned upright and/or to the side relative to the other intermeshable construction units.

Figure 7:
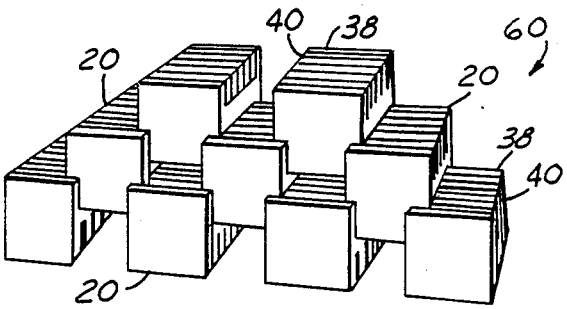
FIG. 7 is a perspective view of the intermeshable construction units stacked to create a diagonal wall structure with openings therein.

Structural strength can be increased in a wall structure 60 by zig-zagging or curving the vertical wall plane as illustrated in FIG. 7. Other methods may include internal peers, constructed of poured-in-place concrete or external intermeshable construction unit pilasters (not shown). When the intermeshable construction units 20 are constructed into the diagonal plane, they can armor, retain or change the angle of repose of the natural embankment.

Figure 8:
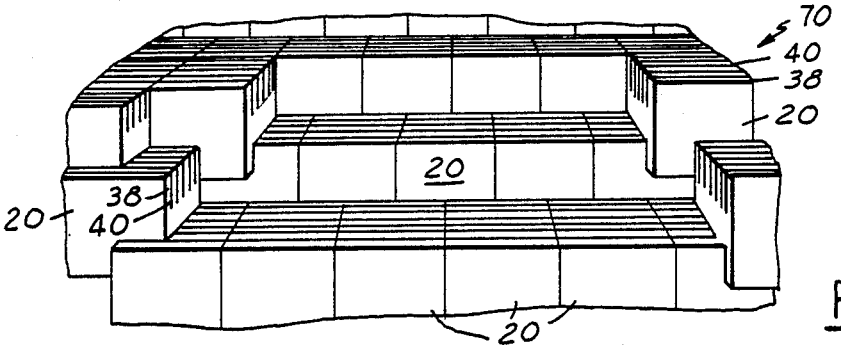
FIG. 8 is a perspective view of the intermeshable construction units stacked to create a structure with terraces.

As illustrated in FIG. 8, by stepping the teeth 38 in the same direction, one or two notches 40 at a time, a structure 70 with terraces can be created that range from the horizontal to the vertical plane for a variety of purposes, including landscaping. To increase the permeability of intermeshable construction unit structures, the units may be spaced further apart to expose the notched area between the teeth 38. This exposed area or clearance may be filled with aggregate or sand back filled, and then compacted and vegetated.

Figure 9:
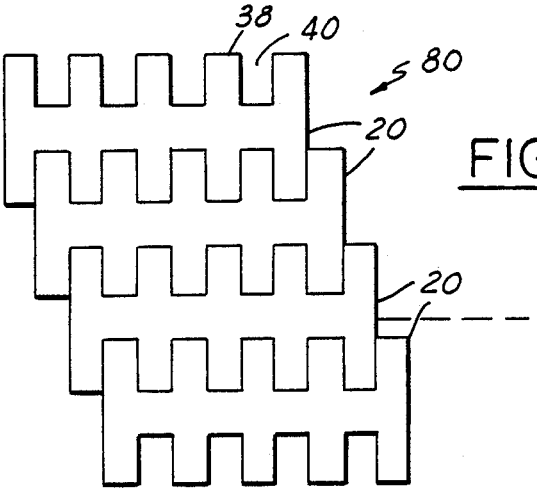
FIG. 9 is an end view of the intermeshable construction units illustrating stacking of the units for a step back retaining wall structures.
Figure 10:
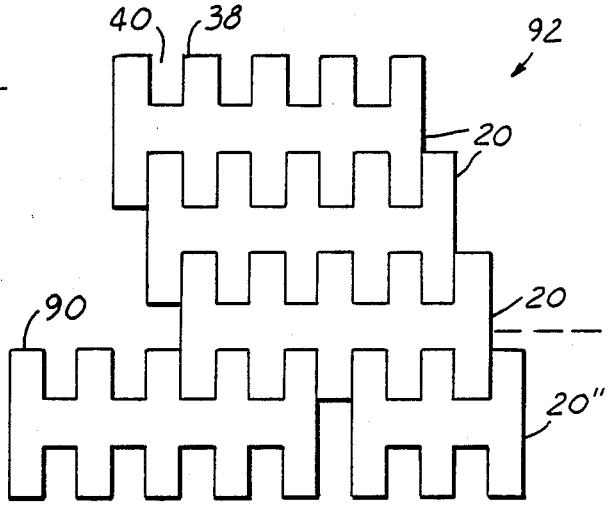
FIG. 10 is an end view of the intermeshable construction units, similar to FIG. 6, illustrating the utilization of a deadman for increased bearing capacity.
Figure 11:
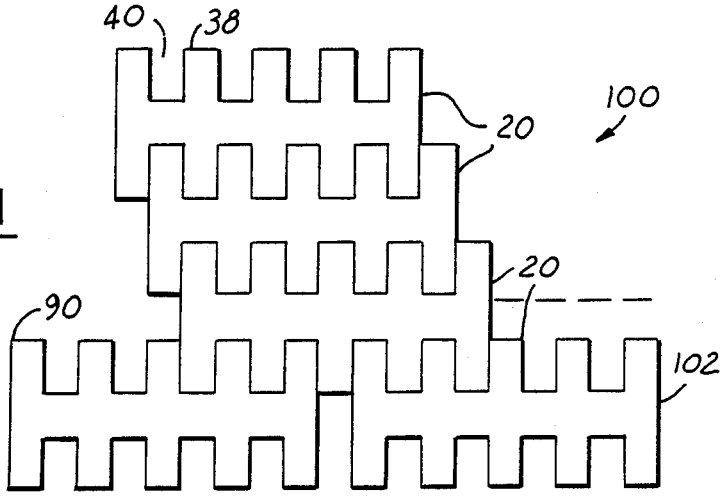
FIG. 11 is an end view of the intermeshable construction units, similar to FIGS. 6 and 7, illustrating the utilization of a toe for reducing the overturn moment and shear forces.

Several alternate foundation designs may be utilized as illustrated in FIGS. 9, 10 and 11. To increase the load bearing capacity of the structures, the intermeshable construction units may be laid on a designed aggregate base in combination with geotextile fabrics (not shown).

A standard stack bonding or common brick pattern for a stepped back retaining wall structure 80 is illustrated in FIG. 9. This pattern reduces the sheer plane within the wall system as previously discussed in association with FIG. 4. The intermeshable construction units 20 may be placed on a compacted sub-base using a geotextile fabric (not shown).

As illustrated in FIG. 10, a deadman 90 may be provided for increasing the bearing capacity of a structure 92 by using a partial intermeshable construction unit 20'' to produce a flush uniform face pattern. It is recommended that a back fill line be used for increased stability and weed control for both in and out of water. The back fill area can be used as beach, lawn or an access road.

As illustrated in FIG. 11, to increase the bearing capacity and stability, and reduce the overturn moment in sheer forces of a structure 100, the standard stack bond pattern with the deadman 90 illustrated in FIG. 10 should be used with a toe protection 102. The toe protection may be used as a chase for installation of decking or docking systems, or may be back filled to support lawn or natural vegetation.

Objects and advantages of the invention are further illustrated by the following example, but the particular material recited in this example, as well as other conditions and details, should not be construed to unduly limit this invention.

EXAMPLE

Intermeshable construction units, of the type illustrated in FIG. 1, having an approximately 8"×8"×16" block configuration with an average weight of approximately 48 lbs. were tested for compression strength. They were found to have average net area compressive strengths of: (1) 4600 P.S.I. along the top 24 (length 15.625" and width 7.625"); (2) 4544 P.S.I. along the side 32 (length 15.625" and width 7.625"); and (3) 1655 P.S.I. along the front end 28 (length 7.625" and width 2.125"). The results revealed for the compressive strengths along the top surpassed the minimum requirements for ASTM C-90, and along the side surpassed the minimum requirement for ASTM C-90. However, there is no ASTM specification that would cover the requirement of the intermeshable construction units tested along the end with such extreme height to base ratio.

While the preferred embodiment of the present invention has been described so as to enable one skilled in the art to practice the techniques of the present invention, the preceding description is intended to be exemplary and should not be used to limit the scope of the invention. The scope of the invention should be determined only by reference to the following claims.

I claim:

1. An intermeshable construction unit (20) comprising:

a generally rectangular block-like shape having a top (24), a bottom (26), a front end (28), a back end (30), a right side (32) and a left side (34);

said front end (28) and back end (30) being of substantially identical size and shape;

said right side (32) and left side (34) each having a series of parallel identical notches (40) extending from said top (24) to said bottom (36), said notches (40) defining a series of parallel identical teeth (38) therebetween which extend from a central spine (36) to said sides, said notches (40) having a width slightly greater than the width of said teeth (38), so that said teeth (38) of the unit (20) may interdigitatingly mesh with the teeth of another identical unit which is arranged in parallel and adjacent relationship therewith;

the length of said unit measured from said bottom to said top being (1) at least twice the depth of said notches measured from said sides of said unit to said central spine and (2) at least four times the width of said teeth.

2. The intermeshable construction unit (20) of claim 1, wherein said teeth (38) on said right side (32) are longitudinally aligned with said teeth (38) on said left side (34).

3. The intermeshable construction unit (20) of claim 1, wherein said top (24) and said bottom (26) are each a substantially continuous planar surface.

4. The intermeshable construction unit (20) of claim 1, which has a square-shaped silhouette when viewed from said front and back ends.

5. The intermeshable construction unit (20) of claim 1, having at least three pairs of said teeth.

* * * * *